United States Patent [19]

Adler et al.

[11] Patent Number: 4,972,117

[45] Date of Patent: Nov. 20, 1990

[54] SPARKLE SUPPRESSION DISPLAYS

[75] Inventors: Robert Adler, Northfield; Hua-Sou Tong, Mundelein, both of Ill.

[73] Assignee: Zenith Electronics Corporation, Glenview, Ill.

[21] Appl. No.: 439,911

[22] Filed: Nov. 20, 1989

Related U.S. Application Data

[63] Continuation-in-part of Ser. No. 298,540, Jan. 16, 1989.

[51] Int. Cl.[5] ..... H01J 29/89

[52] U.S. Cl. ..... 313/478

[58] Field of Search ..... 313/478, 474

[56] References Cited

U.S. PATENT DOCUMENTS

| | | | |
|---|---|---|---|
| 2,612,611 | 9/1952 | Szegho et al. | 313/478 X |
| 3,114,668 | 12/1963 | Guiles | 313/478 X |
| 3,635,751 | 1/1972 | Long, III et al. | 313/478 X |
| 4,644,100 | 2/1987 | Brenner et al. . | |
| 4,700,176 | 10/1987 | Adler | 341/34 X |
| 4,731,558 | 3/1988 | Haisma et al. | 313/478 |
| 4,764,914 | 8/1988 | Estes et al. . | |
| 4,766,424 | 8/1988 | Adler et al. | 341/31 X |
| 4,791,416 | 12/1988 | Adler | 341/34 X |
| 4,794,299 | 12/1988 | Chiodi et al. | 313/408 X |

FOREIGN PATENT DOCUMENTS

| | | | |
|---|---|---|---|
| 0129873 | 10/1979 | Japan | 313/474 |

*Primary Examiner*—Palmer C. DeMeo

[57] ABSTRACT

Glare-reduction means are disclosed for use on, in or with a transparent visual display panel structure having an inner display surface which comprises a periodic pattern of luminous elements. The glare-reduction means on an outer surface of the panel structure has an irregularly rippled surface whose spatial frequency spectrum exhibits a suppression of spatial frequencies in a predetermined band of frequencies related to the spatial frequencies of the pattern of luminescent elements to prevent or reduce visible interference between the patterns.

6 Claims, 4 Drawing Sheets

SPARKLE SUPPRESSION DISPLAYS

CROSS-REFERENCE TO A RELATED APPLICATION

This application is a continuation-in-part of application Ser. No. 298,540 filed Jan. 16, 1989.

BACKGROUND OF THE INVENTION

This invention deals with the problem of undesired reflections present in computer or television displays, especially in color displays. It is well known to reduce or suppress specular reflection by roughening the front surface of the display device, which, for example, could be the glass faceplate of a CRT, or a plastic overlay. However, when such a roughened surface is used in connection with a display screen which is made up of a regular pattern of fine dots or stripes, as is generally the case with direct view color displays, a disturbing phenomenon known as sparkle or random moire' arises: Interference between the spatial frequencies of the dot or stripe pattern and the similar spatial frequencies contained within the broad range of spatial frequencies that characterize a roughened surface, produces beats which appear to move when the observer moves, and which are quite disturbing.

Parent application Ser. No. 298,540 discloses a transparent overlay for color display devices, with an outer surface having sinusoidal ripples along its two major dimensions. Such a surface scatters reflected light and thus renders reflections much less disturbing. It produces no sparkle, no significant moire' and only a very small loss of resolution. This favorable performance is achieved by careful choice of the spatial frequency of the sinusoids, just high enough to be safely above the spatial frequencies of the phosphor dot pattern and of their lowest harmonics. Making the spatial frequency of the sinusoids no higher than what is necessary to avoid moire' preserves resolution by minimizing the diffraction effects.

Such a surface is most economically produced on a plastic overlay by pressing or rolling from a master, a process which is economical if the quantity produced is very large. In smaller quantities, such overlays are substantially more costly than overlays with random surfaces made by conventional spraying; these spray-generated surfaces, however, exhibit objectionable sparkle.

As used herein, "luminous" elements are elements or pixels from which light emanates or appears to emanate, including luminescent elements (cathodoluminescent or electro-luminescent, e.g.) and light-transmissive or light reflective elements (liquid crystal, e.g.).

PRIOR ART

U.S. Pat. Nos. 4,644,100; 4,700,176; 4,764,914; 4,766,424; 4,791,416, and 4,794,299.

OBJECTS OF THE INVENTION

It is an object of this invention to provide means for overcoming the aforedescribed sparkle or random moire' effect which occurs in color cathode ray tubes having surface-roughened type anti-reflective treatments.

It is another object to provide means for overcoming the aforesaid sparkle phenomenon as it occurs in color cathode ray tubes or other color displays with touch-responsive membranes, or other overlays having a random light-scattering treatment on the front surface thereof.

It is yet another object to provide such means which is relatively inexpensive while having favorable anti-reflection properties.

It is still another object to provide means for overcoming the aforesaid sparkle effect which is highly efficient in scattering reflected light, yet does not seriously impair the underlying emitted light image.

It is yet another object to provide means that overcome the sparkle effect without creating undesired effects such as loss of detail or moire', or other artifacts which may impair the viewed image.

It is an object of this invention to provide means for suppressing sparkle, or random moire', while maintaining the reduction of specular reflections characteristic of roughened surfaces.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

As with the invention of the parent application, this invention can be implemented as the configuration of an anti-glare surface of any color or monochrome display having a periodic pattern of luminous elements, irrespective of the overall surface geometry (flat, spherical, multi-radial, aspheric, etc.) The novel surface can be embodied as an integral part of the front surface of a glass faceplate, or a panel in front of a faceplate, or in an overlay for a faceplate or panel, or otherwise used in, on, or with a display in such as way as to reduce glare from light emanating from sources extraneous to the luminous display surface. The light-scattering surface does not have to be the outermost surface.

Figure 1:
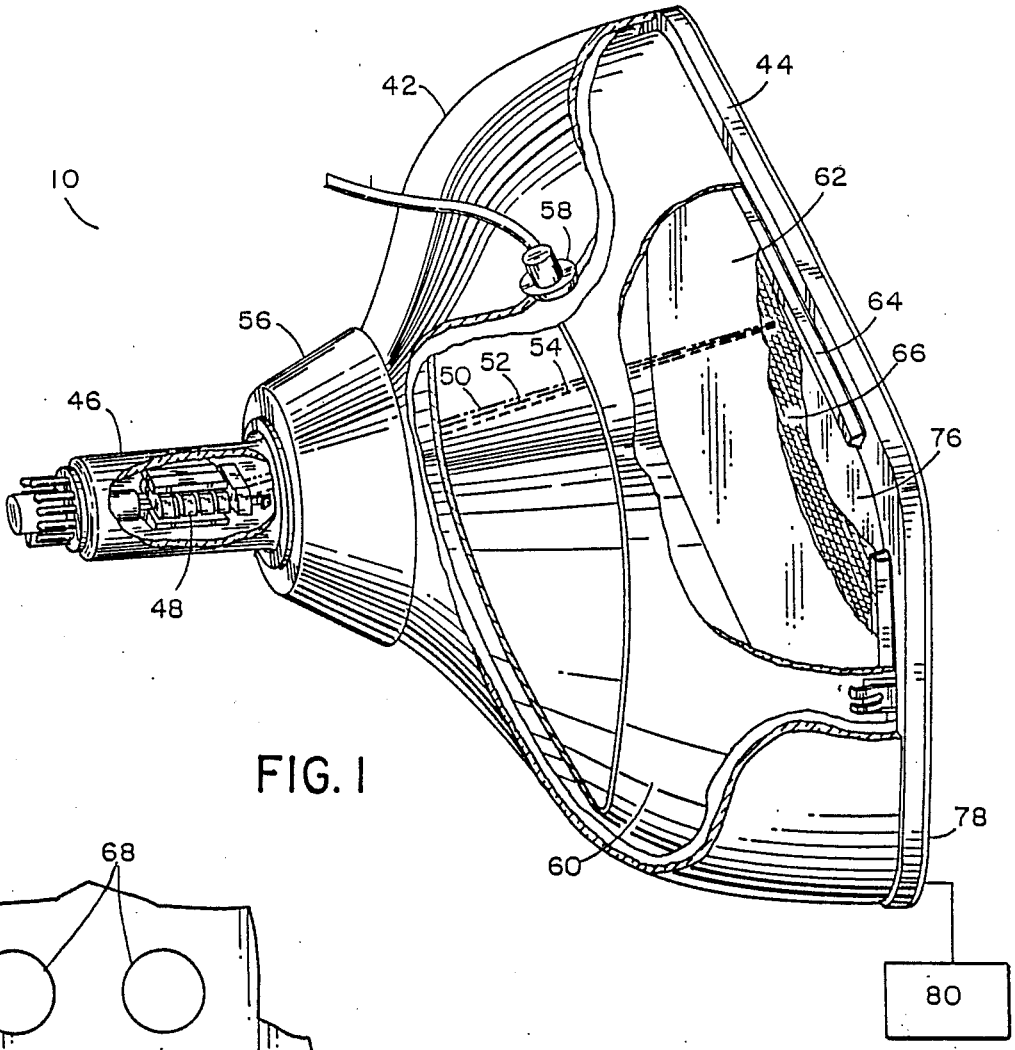
FIG. 1 is a schematic perspective view of a color cathode ray tube equipped with a membrane-type touch response system; the tube envelope is partially cut away to show the location and relationship of major components.

FIG. 1 depicts a flat-tension-mask color cathode ray tube having a membrane touch-responsive overlay to which the invention may be applied.

As discussed above, the problem addressed is a conspicuous "sparkle" effect which has been witnessed in color cathode ray tubes having front surface anti-glare treatments of the type which present random light-scattering centers to reflected light. The pinpoints of light which are described as a "sparkle" can appear in front of or behind the screen and appear to move with head movement. The sparkle effect seems to be limited to high-resolution and medium-resolution displays, but is more pronounced in the high resolution variety. It has been observed in both standard curved-face CRTs and flat-faced CRTs. It is occasionally perceived in color cathode ray tubes of the slot-mask type, but is more pronounced in tubes of the dot-mask variety.

One application in which a disturbing sparkle is seen is a high-resolution color cathode ray tube 10 of the flat tension mask type depicted in FIG. 1. This tube has a touch-responsive membrane with an anti-glare/anti-scratch particulate coating. The tube is modified in accordance with the present invention to overcome the aforedescribed sparkle problem.

Tube 10 is indicated as comprising a funnel 42 joined with a flat faceplate 44. Within the neck 46 of the tube is a three-beam in-line type electron gun 48 which produces red-associated, blue-associated and green-associated electron beams 50, 52, and 54 respectively, which are swept across the screen by electrically energizing a yoke 56.

High voltage is applied to the screen and conductive inner coating through an anode button 58. An internal magnetic shield 60 shields the three beams from the earth's magnetic field and other stray magnetic fields.

Figure 1A:
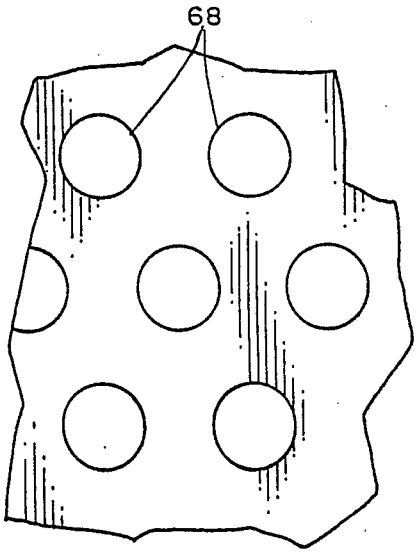
FIG. 1A is a detail view of the apertures of the shadow mask depicted in FIG. 1; FIG. **1*b*** is a detail view of the pattern of phosphor deposits comprising the screen of the tube.
Figure 1B:
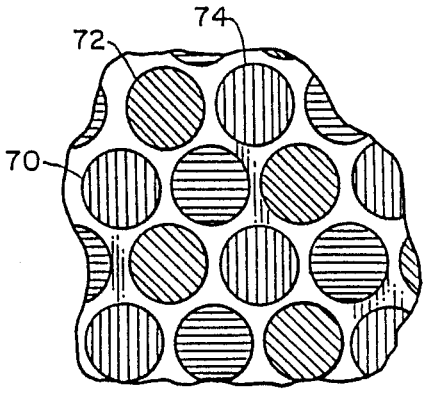

A flat tension mask 62 is supported on support rails 64 in spaced adjacency to a phosphor screen 66. The shadow mask 62 is of the "dot mask" type, that is, one having circular holes 68; the aperture pattern is indicated in detail in FIG. 1A. The screen is of the dot type comprising a hexagonal array of closely packed circular red-emissive, blue-emissive and green-emissive phosphors 70, 72 and, 74 respectively; the phosphor pattern is indicated in detail in FIG. 1B. An aluminum film 76 is used for high voltage energization of the screen and to reflect phosphor-emitted light forwardly to the viewer.

A membrane 78 comprising part of a touch-responsive system is electrically connected to an electronic touch control 80 which monitors and determines the position of a finger touch on the membrane 78.

Figure 2:
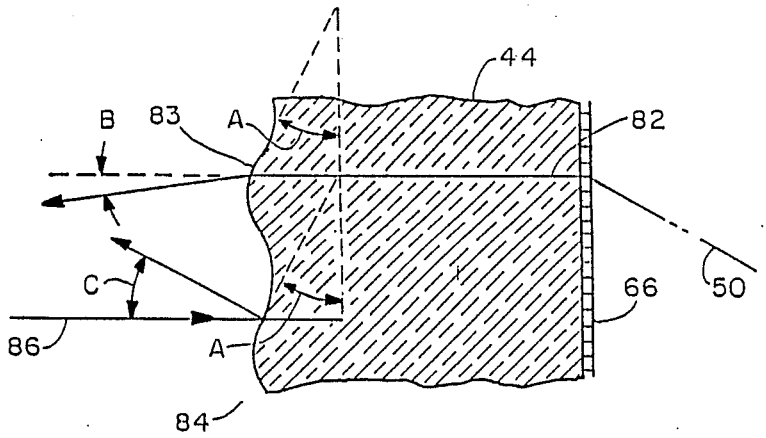
FIG. 2 is a schematic sectional view in perspective of a fragment of the faceplate shown in FIG. 1, illustrating the effect of the invention disclosed in the parent application on emitted image light and reflected ambient light; a cutaway section indicates a pattern of phosphor deposits on the screen area.
Figure 3:
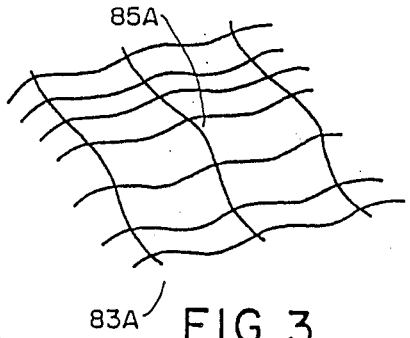
FIG. 3 is a close-up view of a two-dimensional, anti-glare pattern of the invention of the parent application.
Figure 4:
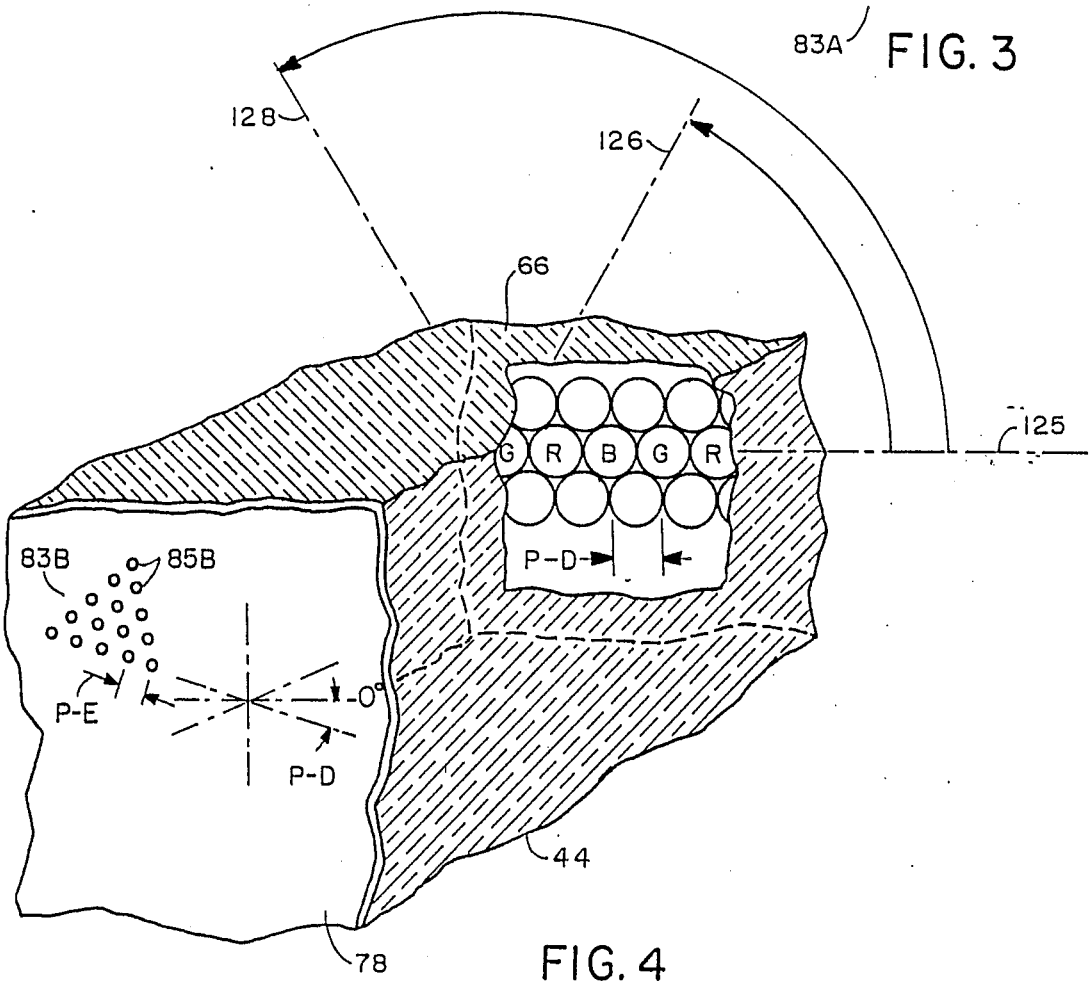
FIG. 4 is an enlarged schematic fragmentary view in perspective of a section of the faceplate of FIG. 1; a touch membrane on the front of the faceplate is shown, and a cutaway section indicates the pattern of phosphor deposits on the screen area opposite.

FIGS. 2–4 depict glare-reduction means in accordance with the invention of the parent application as indicated on the front face of membrane 78. It has been conventional wisdom to use a random light scattering coating or treatment on the face of a color display in order to assure no moiré interaction between the light-scattering anti-glare treatment and the underlying patterned phosphor screen. However, it is believed that, contrary to this conventional wisdom, it is the very random nature of such light scattering anti-glare treatments which is the cause of the described sparkle phenomenon, as will be described in more detail hereinafter. The parent invention radically departs from the prior approach of randomizing the light-scattering surface by substituting a regular pattern 83 of light-scattering elements 84. It has been found that, by appropriately configuring the periodic light-scattering pattern 83, moiré effects are suppressed without loss of the beneficial attributes of the use of a front surface light-scattering treatment. The objectionable sparkle is thus eliminated by that invention without introducing moiré or other deleterious artifacts.

It will be helpful to understand why an anti-glare treatment of the light-scattering type is beneficial. It is understood, of course, that the introduction of light-scattering centers on the front surface of a display, spaced from the cathodoluminescent image surface, will necessarily cause some degradation of the image formed in the cathodoluminescent layer because of the dispersion of the image light as it passes through the light-scattering surface.

FIG. 2 indicates why anti-glare treatments of the light-scattering type are nevertheless beneficial in many applications. A light ray 82 emitted from the phosphor screen 66 passes through the surface of a light-scattering element 83 at an angle "A" relative to the screen 66. From Snell's law for small angles, the ray 82 will be deflected by an angle "B"$=A(n-1)$ from its original course as it emerges from the display into the ambient environment, where "n" is the refractive index of element 83. For many types of glass and for most plastics, n is close to 1.5, so B is approximately 0.5A.

However, a light ray 86 arriving from outside the tube is reflected off the surface of light-scattering element 84 (assumed to be at the same angle "A" relative to the screen 66) through an angle "C" relative to the angle of incidence. Angle "C", according to the law of specular reflection, is equal to 2A and is, therefore, approximately four times angle "B", which is to say that reflected light is scattered to a much greater degree than image light is dispersed. Thus there is a beneficial trade-off of a small amount of image acuity for a large amount of glare reduction.

A color display according to the parent invention has on an inner display surface a periodic pattern of luminescent deposits having a smallest deposit-to-adjacent-deposit pitch "P-D". On an outer surface there are glare-reduction means in the form of an undulating periodic pattern of light-scattering elements whose smallest element-to-adjacent-element pitch "P-E" is significantly less than the pitch "P-D" to avoid moiré effects, but significantly greater than the longest wavelength of visible light to minimize diffraction effects. Each element comprises a gentle undulation having an amplitude great enough to scatter reflected light and suppress specular reflections, but small enough to prevent unacceptable degradation of images formed by the luminescent deposits. The gentle undulations are substantially sinusoidal, and preferably, the pattern of light-scattering elements is azimuthally rotated relative to the pattern of luminescent deposits such that the element axes are intermediate the deposit axes to minimize moiré interaction between the patterns.

In accordance with the preferred execution of the parent invention, a periodic pattern 83A or 83B of light-scattering elements 85A or 85B satisfies a number of requirements. First, the pattern should preferably be two dimensional, although a one-dimensional, washboard-like light-scattering pattern may be employed. FIG. 3 shows a two-dimensional pattern 83A. The reflection of a point source of light is drawn apart into a narrow line by a one-dimensional pattern; light is more effectively scattered and glare-reduced by a two-dimensional pattern which distributes the light reflected from a point source over an area rather than a line.

While the light-scattering pattern 83A of FIG. 3 consists of two undulations intersecting at right angles, thus creating light-scattering elements or convexities 85A, a pattern based on three undulations forming a hexagonal arrangement 83B of convexities 85B separated by valleys, is shown in FIG. 4. This figure also illustrates an essential relationship concerning spatial frequencies.

The spatial frequency of the pattern is critically important in order to prevent moiré interactions with the underlying phosphor pattern. Specifically, the periodic light-scattering pattern will have a smallest element-to-adjacent-element pitch of the input-scattering patterns ("P-E" in FIG. 4) which is significantly less than the smallest phosphor-deposit-to-adjacent-deposit pitch ("P-D" in FIG. 4). "P-E" should be sufficiently smaller than "P-D" so that no beat frequencies between the patterns are visible at normal viewing distances. Further, the pitch "P-E" should be chosen relative to pitch "P-D" such that "P-E" is not harmonically related to "P-D", again to avoid visible beats.

Figure 5A:
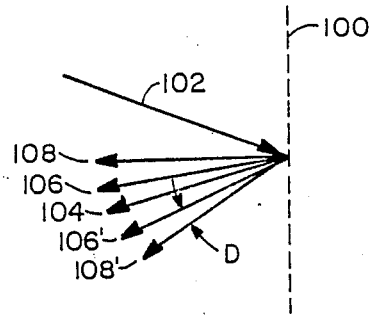
FIGS. 5A and 5B, respectively, show schematically the effect on collimated light when reflected from, and when passing through, a phase grating.
Figure 5B:
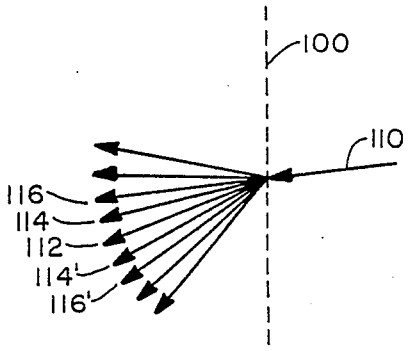

However, at the other extreme, diffraction effects must be minimized. Any transparent sheet or plate carrying a spatially periodic pattern on its surface constitutes a diffraction grating which has the inherent property of splitting incident light, in reflection as well as in transmission, into a number of orders going off in different directions. In FIG. 5A, collimated light is depicted as arriving at grating 100 along a direction 102, and is reflected along direction 104 which is the direction expected from a plane mirror; but light is also reflected along directions 106 and 106'(first order diffraction), 108 and 108'(second order diffraction), and so forth. In FIG. 5B, collimated light 110 is shown as arriving from the opposite side. Some of the light, indicated by reference number 112, continues as if it had been refracted by a plane surface; but light also emerges along directions 114 and 114'(first order), 116 and 116'(second order), and so on.

In the small angle approximation, the angle D between adjacent orders in transmission as well as in reflection equals the light wavelength divided by the grating pitch; for example for a wavelength of 0.56 micrometer (yellowish-green light) and a grating pitch of 56 micrometer, or about 0.0022", angle D is 0.01 radians, or 0.57 degree.

In the case of interest here, the spatially periodic pattern is formed by a corrugated transparent surface which does not obstruct light anywhere, but provides a periodically varying optical path length. This is called a phase grating. As was explained before diffraction was considered, such a grating scatters light over a wider angle in reflection than in transmission; but when diffraction is taken into account, it becomes evident that certain precautions must be taken. This is best illustrated with the aid of a numerical example.

Consider a surface carrying a shallow sinusoidal ripple in one dimension only, so that incident collimated light will be scattered along that dimension. Suppose the maximum angle of the sinusoid with respect to the average plane is plus and minus 1.5 degrees, providing scattering of reflected light over a range of plus and minus 3 degrees, and (assuming a refractive index of $n=1.5$), scattering of transmitted light by plus and minus 0.75 degree. These figures do not take diffraction into account. Two versions of this device, maintaining the same maximum angle and differing only in pitch, will now be compared. Without considering diffraction, they would work equally well.

First assume that the pitch is 100 micrometers or about 0.004". The angle between diffraction orders for yellowish-green light is 0.32 degree. This is a small fraction of the scattering angle even for transmitted light; it means that the transmitted light, rather than being uniformly distributed across the previously mentioned plus and minus 0.75 degree, is split up into five closely-spaced modes—the zero order, a pair of first order modes and a pair of second order modes. Higher order modes, falling outside the 0.75 degree boundary, carry very little light and are not considered here.

Similar reasoning applies to reflection, except that here many more modes exist.

When such a corrugated surface is used as an overlay on a flat tension mask color cathode ray tube, angular scattering of transmitted light at the surface is observed as broadening of screen detail. For the typical thickness of faceplate glass plus plastic overlay, plus and minus 0.75 degree corresponds to an image spread of plus and minus 0.0057", a permissible impairment of resolution. The individual diffraction orders appear separated by only 0.0024", which is not perceptible.

Take, however, a similar grating with a pitch of only 25 micrometers or about 0.001". The angle D between adjacent diffraction orders is now 1.28 degrees. Since this is larger than the scattering angle of plus and minus 0.75 degree for transmitted light, most of the light remains in the zero order mode, which is desirable; however, the two first order modes, while weaker, are strong enough to be visible, and on the flat tension mask tube they appear to be separated from the zero order by plus and minus 0.010", enough to be resolved at normal viewing distance. The resulting triple image is highly disturbing and unacceptable.

In addition, reflected light from the corrugated surface is now split up into about five distinct orders, an effect nearly as disturbing as a single specular reflection. It follows that a pitch smaller than about 0.002" (50 micrometers), corresponding to about 90 wavelengths of yellowish-green light, should not be used.

Figure 5C:
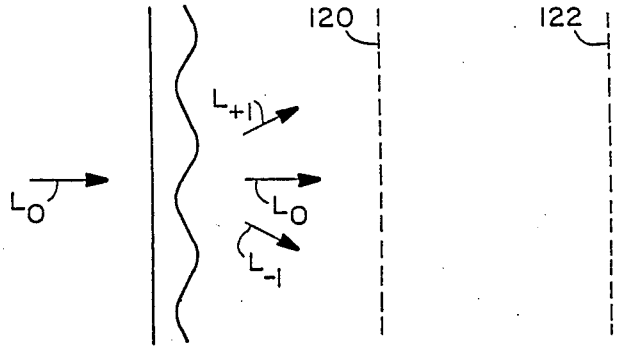
FIG. 5C shows schematically the effect of a phase grating illuminated by spatially coherent light.

There is an additional factor which should be considered in choosing the grating pitch. It was mentioned previously that the corrugated periodic surface constitutes a phase grating. When a phase grating is illuminated by a beam of collimated, spatially coherent light, the phenomena illustrated in FIG. 5C are observed. Specifically, FIG. 5C applies to the case of a sinusoidal grating which generates in transmission only the plus and minus first diffraction orders. The undiffracted light $L_0$ and the two diffracted orders $L_{+1}$ and $L_{-1}$ gradually change their mutual phase relationship as the light travels away from the grating, with the result that a screen 120 inserted at a distance $d=p^2/2\lambda$ ($p$=pitch of grating, $\lambda$=wavelength in the medium which fills the space between grating and screen) would show a sinusoidal pattern of light and dark stripes, i.e. an amplitude grating. At a distance $2d=p^2/\lambda$, the effect disappears again, i.e., a screen 122 inserted at that distance would show uniform illumination and no stripes would be visible.

It has been found that if a periodic pattern of light and dark stripes, simulating the pattern of phosphor dots on the screen of a color tube, is viewed through a phase grating such as the one useful in carrying out the invention of the parent application, similar effects are observed. No moiré pattern, or only a very weak pattern, is visible when the phase grating is laid directly upon the stripe pattern. As the spacing between the two patterns is increased, visibility of the moiré pattern goes through a maximum and then back to a minimum. Because phase gratings produce more than a single pair of orders, the minimum is not as sharp as in the illustration of FIG. 5C, but it is easily observable. This is true even though the different colors produced by a color cathode ray tube form their minima at different distances.

As a numerical example, in a practical case the combined thickness of faceplate, plastic bonding layer, safety glass and plastic overlay may be 0.67″=17 mm. For yellowish-green light, generally considered the predominant color, with a wavelength in air of 0.56 micrometer, and with an average refractive index of 1.5, the predominant effective wavelength within the glass and plastic will be 0.373 micrometer, and the pitch required to achieve the theoretical minimum of moiré visibility is 80 micrometer, or 3.14 mils. As previously explained, this is not a sharp optimum, and the exact pitch should be selected on the basis of overall performance. It is advisable, however, not to depart too much from the theoretical minimum visibility condition, and in any case to avoid choosing a pitch corresponding to the maximum visibility condition.

Thus, in short, the spatial frequency of the light-scattering pattern must be selected sufficiently greater than that of the underlying phosphor pattern that difference frequency beats are not visible, and such that harmonic beats are avoided. Yet the smallest period of the light-scattering pattern must be sufficiently greater than the longest wavelength of visible light to minimize the aforesaid diffraction effects. And finally, consideration must be given to the visibility maximum and minimum for the given distance between pattern 83A or 83B and the phosphor screen.

Yet another requirement realized in a preferred execution of the invention of the parent application is that the undulations in the surface, the "tilt angle" of the light altering surface, be as low in amplitude as possible (in order to minimize image light dispersion), yet great enough to achieve the minimum necessary scattering of ambient light. Further, in order to minimize diffraction-induced dispersion of image light, it is desirable to come as close to a sine wave profile in the light-altering surface as is possible. For example, in a preferred execution, the light-altering surface of the light-scattering pattern would have maximum tilt angles of about 1.5 degrees and would be purely sinusoidal.

The light-scattering pattern 83A or 83B is preferably rotated relative to the underlying phosphor screen pattern. As illustrated in FIG. 4, the light-scattering pattern 83B is shown rotated relative to the three major axes of the phosphor pattern, as explained in the following.

It has been found that the pitch P-E of the light-scattering pattern 83B is less critical if that pattern is rotated azimuthally relative to the underlying pattern of phosphor deposits, such that the element axes are intermediate the deposit axes and are positioned to minimize moiré effects. In the illustrated embodiment, the phosphor deposits form an equilateral hexagonal pattern which has two pronounced spatial frequencies (see FIG. 4), one along the horizontal axis 125 (i.e. at 0 degrees), at 60 degrees (126) and 120 degrees (128) to that axis, the other at 30, 90 and 150 degrees from the horizontal (not indicated). In the preferred embodiment, a hexagonal light-scattering pattern 83B is rotated about 15 degrees relative to the underlying phosphor pattern. Light-scattering pattern 83B consists of three sets of gently undulating sinusoidal ripples which intersect at 60 degree angles, thus forming a surface having a hexagonal pattern of convexities 85B separated by intersecting valleys.

A light-scattering pattern consisting of only two undulations intersecting at right angles may be used in place of the hexagonal pattern, and again its pitch is found to be less critical if its two axes are rotated by a small angle with respect to the 0 and 90 degree axes of the phosphor pattern.

In a flat tension mask color cathode ray tube of the type illustrated, it is known to vary the pitch of the phosphors across the screen in order to reduce or eliminate beam "degrouping." (See U.S. Pat. No. 4,794,299, for example.)

The glass faceplate of a shadow mask color cathode ray tube display has on an inner display surface a periodic pattern of luminescent deposits whose smallest deposit-to-adjacent-deposit pitch "P-D" is different in different parts of the display. A touch-responsive membrane on the faceplate has on an outer surface glare-reduction means comprising a periodic pattern of light-scattering elements whose smallest element-to-adjacent-element pitch "P-E" is significantly greater than the longest wavelength of visible light to minimize diffraction effects. The pitch "P-E" varies across the display to preserve a predetermined geometrical relationship between the patterns in at least predetermined different parts of the display when the membrane is overlaid on the display. This arrangement is effective to eliminate sparkle and moiré in all parts of the screen.

Figure 6A:
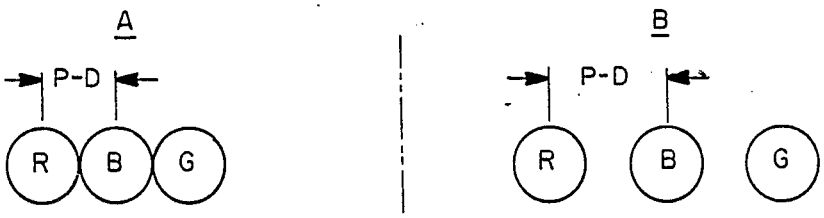
FIGS. 6A and 6B illustrate schematically the variance of pitch of light-scattering elements in correlation with the variance of pitch in corresponding phosphor deposits.
Figure 6B:
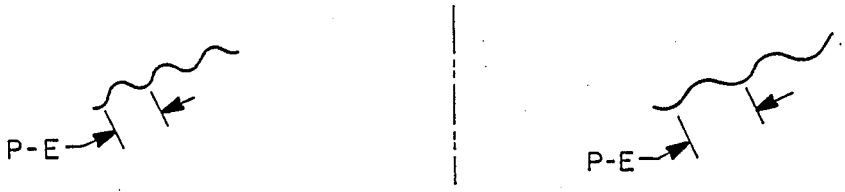

FIG. 6A shows schematically a phosphor screen wherein the phosphor deposit pitch P-D increases from the center of the screen (zone "A") to the edge of the screen (zone "B"). As shown in FIG. 6B, a corresponding increase in the pitch P-E of the light-scattering elements may be employed. The concept may be reduced to practice in an application of the type described by embossing the surface of a plastic sheet with a heated roller, or by compression or injection molding.

A preferred embodiment of the invention of the parent application operates in connection with a high-resolution color tube in which the smallest phosphor deposit pitch P-D is 0.00534 inch in the central region of the tube, the corresponding directions being 30, 90 and 150 degrees from the horizontal. The smallest pitch "P-E" of the light-scattering pattern is 0.0035 inch along two orthogonal directions. The orientation of the light-scattering pattern is not critical, however a useful range is centered at 15 degrees from the horizontal. Along each of the two orthogonal directions of the pattern, the surface profile is a sinusoid with a peak-to-peak amplitude of 0.75 micrometers, and with a maximum slope of plus and minus 1.5 degrees.

The invention of the parent application has been described in connection with a dot-type screen and dot mask; however, the invention is just as applicable to tubes using the slot mask and phosphor stripes, as opposed to phosphor dots. The choice of spacing between light-scattering elements is not as critical with a line screen as it is with a dot screen. In any case, the pattern of light-scattering elements would still be two-dimensional; e.g., as shown in FIG. 3.

Generally, with dot screen as well as line screens, the optimum spatial frequencies along two orthogonal axes, e.g., the horizontal and vertical directions, will not be the same, and it is within the scope of this disclosure to use different spacings between light-scattering elements along two orthogonal axes.

THE PRESENT INVENTION

We have found that performance comparable to that of the sinusoidal overlays can be obtained with a near random configuration of surface ripples. To accomplish this beneficial result, the range of spatial frequencies capable of beating with the spatial frequencies of the phosphor dot pattern, and their lowest harmonics, is suppressed while the region of spatial frequencies directly above this range is emphasized.

Figure 7:
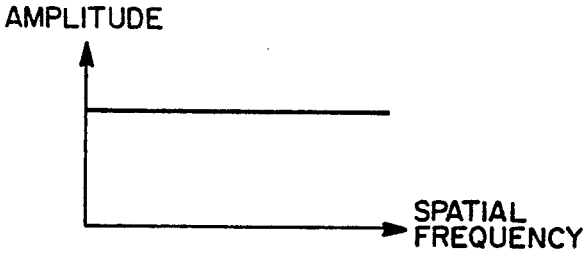
FIG. 7 is a graph indicating the constancy of the power density of electrical noise over a wide range of frequencies.

A comparison with electrical random noise may make this clearer. Many conventional sources of electrical noise generate voltage or current fluctuations whose power density, expressed in watts per Hertz, is constant over a wide range of frequencies. This type of electrical noise is often called "white noise," recalling the fact that white light results from the simultaneous presence of light covering a broad range of optical frequencies. Similarly, a roughened surface, such as that of an etched glass plate, has microscopic ripples which may be characterized as covering a broad range of spatial frequencies, so that its spatial frequency spectrum may approach the idealized flat spectrum shown in FIG. 7.

Electrical voltages or currents constituting white noise may be passed through frequency-selective filters to change their spectral characteristics. Similarly, the configuration of a rippled surface may be so chosen that while the ripples are generally random, a certain range of desired spatial frequencies is emphasized while other spatial frequencies are suppressed.

Figure 8A:
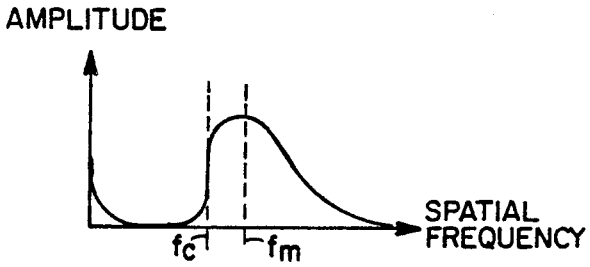
FIG. 8A is a graph of the spatial frequency spectrum of a rippled surface according to the invention.

FIG. 8A shows a frequency spectrum of this type. The pass band, centered at $f_m$, is terminated on its low-frequency side by a well-defined, sharp cutoff $f_c$, while the high-frequency side trails off more gradually. Below the cutoff there is a stop band which extends almost to zero frequency; a narrow range of extremely low frequencies, including zero, is not suppressed.

Figure 8B:
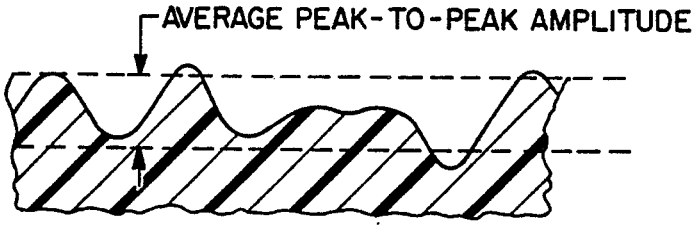
FIG. 8B is a section through such a surface.

According to this invention, a surface of a display device—this may be the surface of an integral part of the device itself or the surface of a transparent overlay—is shaped to follow, along both major dimensions, a near random pattern of ripples having a spatial frequency spectrum of the nature shown in FIG. 8A. As previously explained, the lower cutoff frequency $f_c$ of the pass band should be chosen so as to avoid the predominant frequencies of the dot pattern and of the lowest harmonics thereof. For example, for a hexagonal dot pattern with predominant spatial frequencies of 108 per inch at zero degrees, 60 degrees and 120 degrees, and of 188 per inch at 30 degrees, 90 degrees and 150 degrees, one would choose a lower cutoff of about 375 per inch. The upper cutoff is not critical, but the amplitude should decrease fast enough to avoid unnecessary loss of resolution by diffraction. In the numerical example just given, the ripple amplitude at $2f_c$ should be at least three times lower than at the mid-frequency $f_m$. An example of a section through a rippled surface having the spectral characteristics depicted in FIG. 8A is shown in FIG. 8B.

Figure 9:
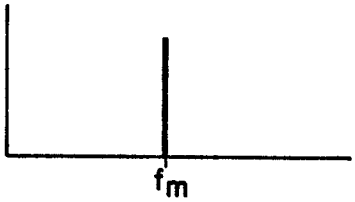
FIG. 9 is a graph of the spatial frequency spectrum of a sinusoidally rippled surface having a spatial frequency $f_m$.

Ripples having the spatial frequency spectrum illustrated in FIG. 8A bear a strong resemblance to purely sinusoidal ripples with a spatial frequency $f_m$. Such sinusoidal ripples, which form the basis for the parent application, would have the frequency spectrum shown in FIG. 9. However, in the device made according to this invention, the amplitude of the individual ripples varies randomly about an average, even dropping to zero in a few places, and the spacing between ripples varies as much as, for example, 50 percent.

The average amplitude of the surface ripples is chosen on the basis of a tradeoff. Higher amplitudes produce improved glare reduction but impair resolution. A typical compromise value may be 0.2 microns RMS, corresponding to an average of about 0.56 microns peak to peak.

Surfaces of this shape can be made on plastic sheets by pressing or rolling, preferably at an elevated temperature; in this process, the surface configuration of a metal master is transferred to the plastic sheet. The master itself may be produced by a process similar to the well-known procedure for making video disc masters: A flat, polished glass or metal plate is coated with a thin layer of photoresist. The photoresist is exposed point-by-point in a laser scanner, i.e., a machine in which a sharply focused laser beam sweeps across the photoresist surface, following a television-like raster. The intensity of the laser beam is modulated by random noise which has passed through appropriate selective filters so as to produce the desired spatial frequency spectrum (FIG. 8A) along both coordinates. This involves filtering by frequency-selective circuits to obtain the desired pattern along the direction of rapid scan (horizontal in a television raster); it further involves establishing the desired degree of correlation between scanning lines that are approximately one ripple wavelength ($1/f_m$) apart along what would be the vertical direction in a television raster.

The exposed photoresist layer is then developed and thereby takes the desired shape. It is then coated with a thin layer of electroless nickel. A thicker layer of nickel is electrolytically deposited thereon. This nickel layer constitutes the master which may be used, directly or by way of intermediate masters, to press or roll large numbers of plastic replicas.

We have found that surfaces of the desired shape can also be made by conventional spraying processes. This is true because, in a well-controlled spraying process, the droplets arriving at the substrate are of fairly uniform size, varying randomly about an average diameter but rarely exceeding it by, for example, more than 50 percent. Since it is the larger droplets which produce the undesired lower spatial frequencies, avoidance of such larger droplets results in the desired spatial frequency spectrum of FIG. 8A. For example, a procedure involving the following parameters has been used successfully:

| | |
|---|---|
| Solution chemistry: | Tetrachloro-Silane - 2.8 wt % |
| | Anhydrous Ethanol - 97.2 wt % |
| Reaction mechanism: | $C_2H5OH \rightarrow$ (evaporation) |
| | $C_2H_5OSiCl_3 \rightarrow (Si—O—Si)_x + HCl$ |
| Spraying parameters: | Fluid nozzle orifice: 0.04 inch in diameter |
| | Air pressure: 65–75 psi |
| | Liquid pressure: 5–10 psi |
| | Distance between nozzle and substrate: 1½ ft. |
| | Substrate temperature: 90–120 degrees C. |
| | Curing temperature: 120–200 degrees C. |
| | Curing time: 15–60 minutes |

Figure 10:
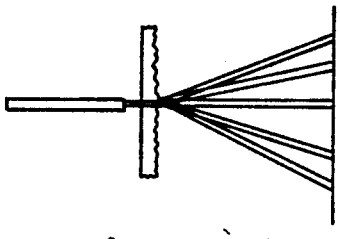
FIG. 10 depicts diagrammatically a quantitative measuring tool capable of determining the spatial frequency spectrum of a sample surface; and, FIG. 11 depicts a sample diffraction pattern produced by the tool of FIG. 10.
Figure 11:
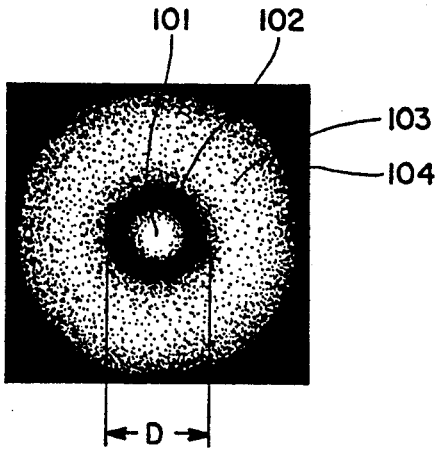

To verify that a surface having the configuration according to the invention has been generated, it is useful to have a quantitative measuring tool capable of determining the spatial frequency spectrum of a sample surface quickly and reliably. For this purpose, the arrangement shown in FIG. 10 may be used. A collimated laser beam, of a diameter many times larger than the average wavelength of the ripples on the sample surface, is passed through the sample. For a cutoff wavelength of 2.67 mils, corresponding to the above-mentioned cutoff frequency of $f_c$=375 ripples per inch, a beam diameter of about 60 mils, characteristic of a small helium neon laser, is sufficient. The ripples constitute a two-dimensional diffraction grating; as the beam is passed through the sample, a diffraction pattern appears on a screen placed one or two feet away from the sample. A typical pattern for a good sample is shown in FIG. 11. It consists of a bright spot 101 in the center, corresponding to zero spatial frequency, surrounded by a dark ring 102 corresponding to the suppressed frequencies below $f_c$ (see FIG. 8A). Using a helium neon laser emitting red light of 0.633 micron wavelength, and a sample-to-screen distance of 20 inches, the outside diameter D of the dark ring measured in mils equals the cutoff frequency $f_c$ expressed in ripples per inch—375 in the example previously given.

The dark ring is surrounded by a bright ring 103 corresponding to the spatial frequency content of the pattern above $f_c$. The ring 103 fades gradually into an outer dark region 104. While the diameter of this transition region is not as well defined as a cutoff diameter D, it is desirable for it not to be larger than 2D.

Somewhat sharper images may be obtained on the screen if a lens having a focal length about equal to the screen-to-sample distance (in this example, about 50 cm.) is inserted adjacent to the sample.

The measuring setup just described yields accurate information regarding the spatial frequency spectrum, the feature which characterizes the invention. We have found that commercial anti-glare coatings produce unsatisfactory performance when used on color screens because they exhibit the phenomenon known as sparkle or random moiré. When these samples are tested in the setup shown in FIG. 10, they do not produce a diffraction pattern such as that shown in FIG. 11; the dark ring is absent, indicating the presence of strong spatial frequency components in the critical range where beats with the spatial frequencies of the dot pattern produce random moiré. Conversely, we have found that any time a sample yields the dark ring pattern shown in FIG. 11 with even approximately the right diameter D, little or no moiré is produced.

The laser equipment described in the foregoing may also, with a minor addition, serve to monitor the amplitude of the surface ripples. For this purpose a photodetector with a suitable aperture—for example a round window with 1–2 mm diameter would be appropriate for the 20 inch screen-to-sample distance mentioned earlier—is connected to a microamperemeter. The detector is first placed so that the aperture coincides with the bright center spot 101. It is then moved so that the aperture travels radially outward, and readings are recorded. The result will be a curve of the general shape of FIG. 8A; high amplitude in the bright region 103 (at fm) corresponds to better glare suppression but may also produce greater resolution impairment. The amplitude in the dark region 102 should be very low; any light present in this region produces undesirable random moiré or sparkle.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

I claim:

1. For use on, in or with a transparent visual display panel structure having an inner display surface which comprises a periodic pattern of luminous elements, glare reduction means on an outer surface of said panel structure having an irregular rippled pattern of light scattering elements whose spatial frequency spectrum exhibits a suppression of spatial frequencies in a predetermined band of frequencies related to the spatial frequencies of said pattern of luminous elements to prevent or reduce visible interference between said patterns.

2. The apparatus according to claim 1 wherein the upper limit of said band defines a cut-off frequency, and in which spatial frequencies exceeding twice said cut-off frequency are attenuated.

3. A transparent visual display panel structure having on an inner display surface luminous elements arranged in a periodic pattern having a predetermined range of spatial frequencies, said panel structure having on an outer surface glare reduction means in the form of an irregular rippled pattern of light-scattering elements having a spatial frequency spectrum in which spatial frequencies in said predetermined range of spatial frequencies are suppressed to prevent or reduce visible interference between said patterns.

4. The apparatus defined by claim 3 wherein the upper limit of said range defines a cut-off frequency, and in which spatial frequencies exceeding twice said cut-off frequencies are attenuated.

5. A transparent visual display panel structure having on an inner display surface luminous elements arranged in a periodic pattern having a predetermined range of spatial frequencies, said panel structure having on an outer surface glare reduction means in the form of an irregular rippled pattern of light scattering elements having a spatial frequency spectrum which contains components above said predetermined range of spatial frequencies, but in which spatial frequencies within said range of spatial frequencies are suppressed to prevent or reduce visible interference between said patterns while achieving a desired degree of scattering of reflected light.

6. For use on, in or with a transparent visual display panel structure having an inner display surface which comprises a periodic pattern of luminous elements having a predetermined range of spatial frequencies, glare reduction means on an outer surface of said panel structure having an irregular rippled pattern of light scattering elements whose spatial frequency spectrum contains components above said predetermined range of spatial frequencies, but in which spatial frequencies within said range of spatial frequencies are suppressed to prevent or reduce visible interference between said patterns while achieving a desired degree of scattering of reflected light.

* * * * *